US006814153B2

(12) United States Patent
Hecht et al.

(10) Patent No.: US 6,814,153 B2
(45) Date of Patent: Nov. 9, 2004

(54) HAND POWER TOOL

(75) Inventors: Joachim Hecht, Magstadt (DE); Joerg Lemmel, Weinstadt (DE); Stephan Jonas, Evanston, IL (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/997,752

(22) Filed: Nov. 30, 2001

(65) Prior Publication Data

US 2002/0084087 A1 Jul. 4, 2002

(30) Foreign Application Priority Data

Nov. 30, 2000 (DE) ..... 100 59 389

(51) Int. Cl.[7] ..... B25D 11/00

(52) U.S. Cl. ..... 173/47; 173/104; 173/217; 173/48

(58) Field of Search ..... 173/47, 48, 216, 173/217, 104, 112, 114, 109, 201, 128

(56) References Cited

U.S. PATENT DOCUMENTS

| | | | | | |
|---|---|---|---|---|---|
| 2,968,960 | A | * | 1/1961 | Fulop | 173/46 |
| 3,809,168 | A | * | 5/1974 | Fromm | 173/13 |
| 3,841,418 | A | * | 10/1974 | Biersack | 173/109 |
| 3,931,744 | A | * | 1/1976 | Wunsch | 173/48 |
| 4,669,551 | A | * | 6/1987 | Lippacher et al. | 173/109 |
| 5,025,903 | A | * | 6/1991 | Elligson | 192/83 |
| 5,427,188 | A | * | 6/1995 | Fisher | 173/205 |
| 5,513,709 | A | * | 5/1996 | Fisher | 173/205 |
| 5,538,089 | A | * | 7/1996 | Sanford | 173/2 |
| 5,704,433 | A | * | 1/1998 | Bourner et al. | 173/48 |
| 5,711,380 | A | * | 1/1998 | Chen | 173/48 |
| 5,775,440 | A | * | 7/1998 | Shinma | 173/109 |
| 6,089,330 | A | * | 7/2000 | Miescher et al. | 173/132 |
| 6,199,640 | B1 | * | 3/2001 | Hecht | 173/48 |

FOREIGN PATENT DOCUMENTS

| | | |
|---|---|---|
| DE | 196 21 090 A1 | 12/1996 |
| DE | 297 03 469 U1 | 6/1997 |
| DE | 197 26 383 A1 | 12/1998 |

* cited by examiner

*Primary Examiner*—Scott A. Smith
*Assistant Examiner*—Paul Durand
(74) *Attorney, Agent, or Firm*—Michael J. Striker

(57) ABSTRACT

A hand held power tool has a housing, a drive, a mechanical striking mechanism with a striker, a drive element for driving the striker in its striking movement and having at least one curved track with raised and depressed portions, and a sensing element in operative connection with the striker supported on the drive and having a sensing member bringable in operative position with the raised and depressed portions of the curved track.

11 Claims, 6 Drawing Sheets

HAND POWER TOOL

BACKGROUND OF THE INVENTION

The present invention relates to hand power tools.

German reference DE 197 26 383 discloses a hand power tool which is an electrically driven hammer drill. The hammer drill has a work spindle which is rotatably driven and supported in a housing and drives a tool receptable for a tool. Furthermore, the hammer drill has a mechanical striking mechanism which has a striker axially displaceable in the work spindle formed as a hollow shaft and accelerated in an axial direction. During the operation it acts directly or indirectly on the shaft of the tool. A drive unit acts on the striker. It derives an axial acceleration of the strike from the rotational movement of the work spindle. The drive unit includes a sensing unit which rotates synchronously with the work spindle and is axially displaceable. It is guided with an axial gap between two ring shaped curved tracks non rotatably arranged relative to the working spindle and provided with raised portions and depressed portions arranged near one another in an axial direction of the work spindle. The sensing unit is formed as a ring-shaped component which is supported axially displaceably on the striker in an axial direction against a pressure spring. It has a radially outwardly extending sensing unit which engages through a slot in the work spindle between the curved tracks and is bringable in operative connection with the curved tracks via the sensing unit.

The curved track which faces the tool is axially displaceably supported for turning on and turning off of the striking mechanism together with the work spindle. If the tool is pressed against a surface to be treated, the work spindle and the curved track facing the tool displaces in direction of the curved track facing away from the tool axially against an idle spring which is formed as a pressure spring. Therefore the sensing member during a rotational movement comes to abutment with the both curved tracks. The impact mechanism is turned on.

If the tool is lifted from the surface to be treated, the curved track which faces the tool and the working spindle is moved back by the idle running spring to its initial position. The distance between both curved tracks is therefore increased so that the sensing member can rotate freely between the both curved tracks without coming to abutment with them. The striking mechanism is turned off.

SUMMARY OF THE INVENTION

It is therefore an object of the present invention to provide a hand power tool which avoids the disadvantages of the prior art.

More particularly it is an object of the invention to provide such a hand power tool, in particular an impact drilling power tool which has a drive means which is drivably supported in a housing, a mechanical striking mechanism for a striking drive of a tool in a tool receptacle and having a striker which is drivable in its striking movement via a drive movement, the at least one curved track with raised and depressed portions located near one another in an axial direction of the tool and with a sensing unit which is inoperative connection with said striker and has at least one sensing unit which is bringable in an operative connection with the raised and depressed portions of the curved track.

In particular in impact drilling power tools with a quick clamping chuck or a toothed rim drilling chuck and a full shaft, in a simple and cost favorable manner an advantageous striking mechanism with a striker can be provided. Recommended standard components can be substantially retained and an expensive new constructions can be avoided. Furthermore, hollow shafts for guidance of the striker can be avoided and thereby required costs can be saved. The inventive solution can be used in a structurally simple manner for other hand power tools, such as for example for scrapers, etc.

When the drive means is supported axially displaceably, and a projection of a drive means in direction of tool receptacle forms an abutment for the striker, additional components, structural space, mounting expenses and costs can be avoided, and in a structurally simple and efficient manner an impulse released by the striker can be transmitted to the drive means to the tool.

In accordance with a further embodiment of the present invention it is proposed to form a curved track on a cup-shaped sleeve and to arrange the projection inside the sleeve. Therefore an advantageous noise screening can be provided.

When the drive means is formed as a shaft, and at least a part of the sensing unit is connected non rotatably with the drive means and driven directly from the drive means, additional components for rotary transmission are avoided and structural space, weight and mounting expenses are saved. In particular when the drive means is formed as a shaft with a small diameter, it can be of advantage that at least a part of the sensing unit is connected with a drive part which is formed separately from the drive means. An additional loading and/or weakening, for example by grooves formed in the drive means, can be avoided. Instead, a rotatably driven sensing unit can be basically rotatably drivable from the curve tracks.

In accordance with a further embodiment of the invention it is proposed that the sensing unit includes two and preferably three or more sensing members which are bringable in operative connection with the curved track or with the curved tracks. Thereby a tilting moment on the sensing unit and the striker is avoided, and a centering of the sensing unit on the curved tracks can be provided. The operational efficiency can be increased and the wear reduced.

In order to guarantee a reliable coupling and uncoupling of the striking mechanism and a reliable idle running adjustment, at least one sensing member of the sensing unit in an idle running position is limited in its movement in an axial direction of at least one, preferably two curved tracks toward both curved tracks by a corresponding abutment. When the drive means is supported axially displaceably and an abutment is formed by a means which is fixedly arranged on the drive means, such as for example a safety ring or a projection formed on the drive means, etc., an uncoupling movement of the drive means is preferably used so that an abutment can be positioned correspondingly for limiting the movement of the sensing member of the sensing unit.

Furthermore, additional components, structural space weight, and mounting expenses can be saved when the spring which is in operative connection with the striker forms at least a sensing member and/or at least a drive element of the sensing unit.

When at least one curved tracks is supported displaceably against a spring which is tensioned via the sensing unit, an especially structurally simple and cost-favorable striker can be provided.

Instead of two curved tracks, between which the sensing unit is arranged, the driver unit can be also provided with only one curved track, and exclusively with such a curved track whose raised portions and depressed portions are arranged axially in direction of the tool. The device mut be formed so that the sensing unit is moved back by a spring and/or by a strike of the striker against an abutment surface in direction of the curved track. In this case, when compared with a driver unit with two curved tracks, additional components, structural space and weight can be saved.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
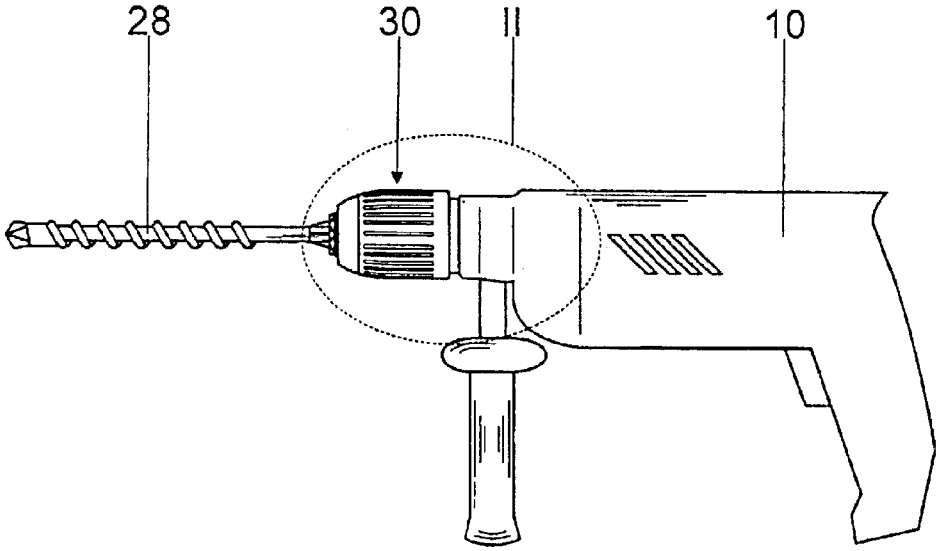
FIG. 1 is a side view of an impact drilling power tool in accordance with the present invention.
Figure 2:
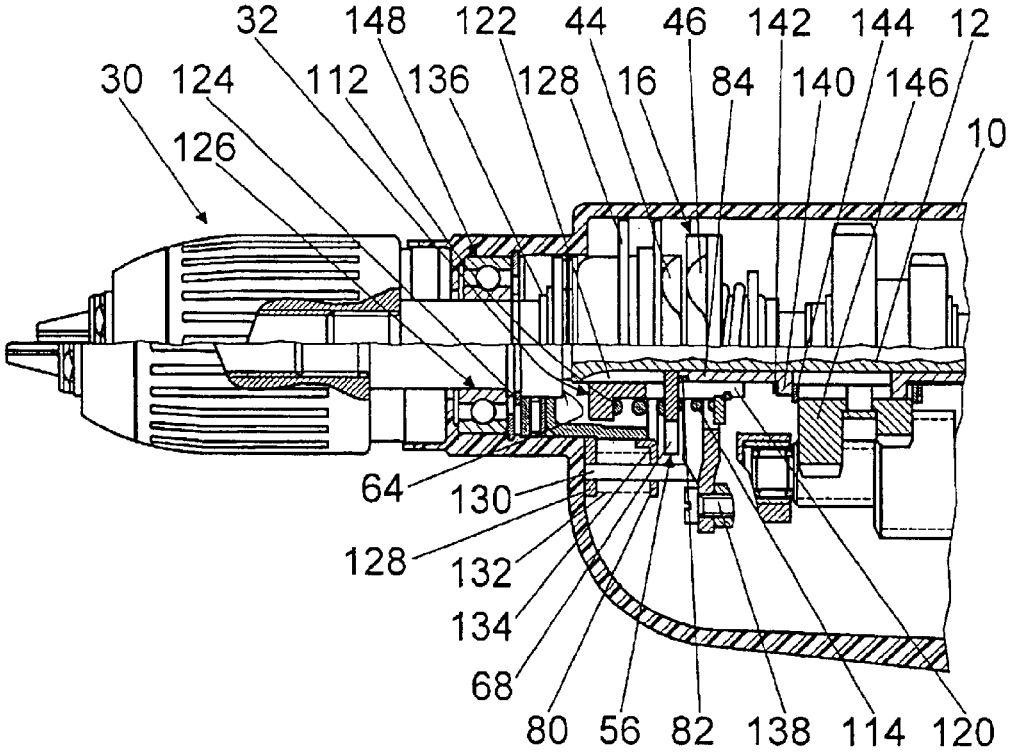
FIG. 2 is a view showing a fragment 2 of FIG. 1 of the inventive power tool in a section.
Figure 3:
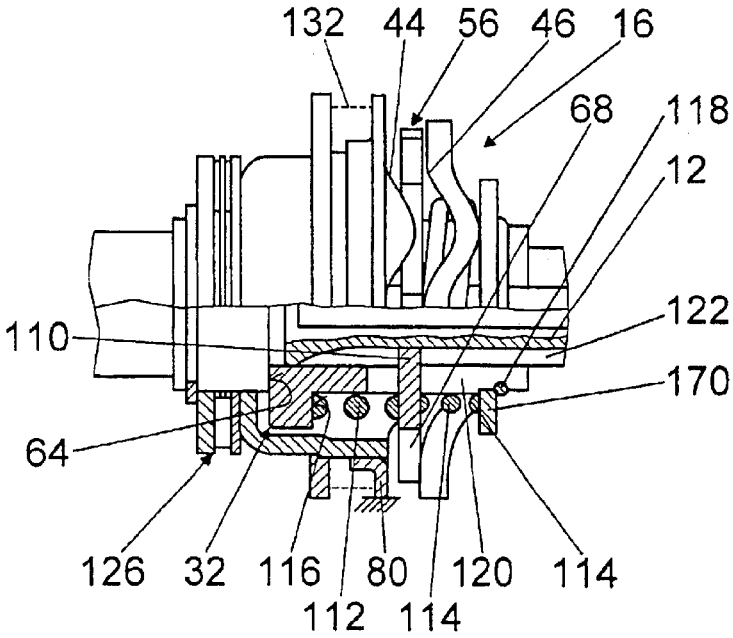
FIG. 3 is a view showing a section of a striking mechanism of the power tool shown in FIG. 1 during a striking operation.

FIG. 1 shows an impact drilling power tool in a side view. It has a housing 10 and a drive means 12 which is formed as a spindle and is rotatably driven in the housing 10 by a not shown electric motor (FIGS. 2 and 3). The impact drilling power tool has a mechanical striking mechanism 16 for a striking operation of a drill 28 which is held in a tool receptable 30 formed as a quick clamping chuck. The tool receptable 30 is screwed with an inner thread on an outer thread of the drive means 12.

The striking mechanism 16 has a striker 32 which is drivable in its striking movement via a drive unit. The drive unit has two ring-shaped curved tracks 44, 46 which are non rotatably arranged in the housing 10. In an axial direction of the drive means 12, they are provided each with five successive sine-shaped depressed portions and raised portions. Basically, also more or less raised portions and depressed portions are possible. Furthermore the curved tracks can be used which have different amplitudes and/or curved courses, for example different from a sine-shape. In a hand power tool with a tool which does not move in the rotary direction, the curved tracks are provided only with one raised portion and one depressed portion.

Figure 4:
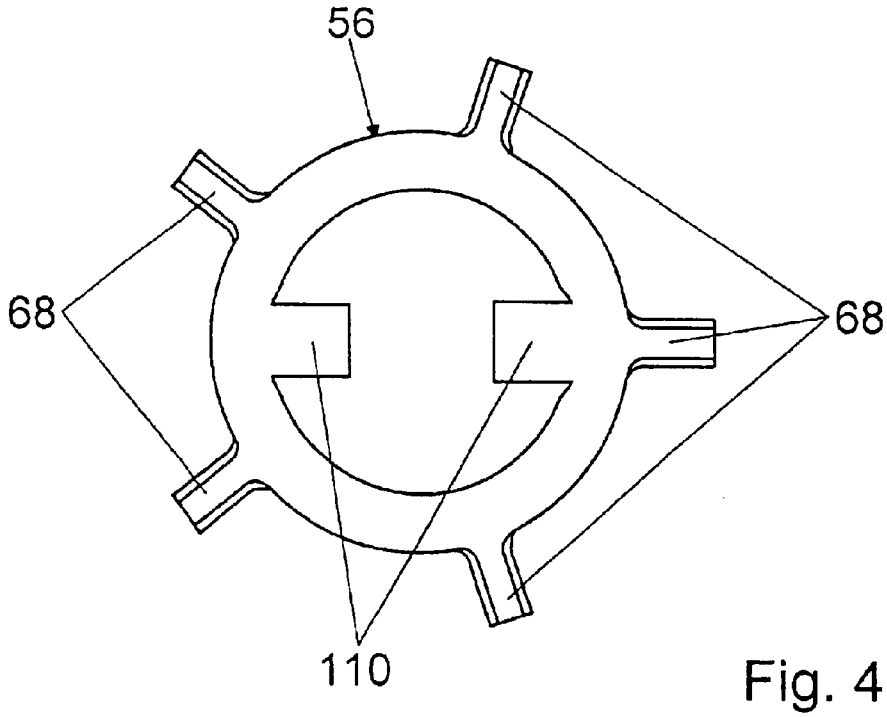
FIG. 4 is a view showing a sensing unit of the inventive power tool.

A rotatably driven sensing unit 56 is arranged between the curved tracks 46, 48. The sensing unit 56 is formed as a ring-shaped component. It has five radially outwardly extending web-like sensing members 68 and two radially inwardly extending drive elements 110 shown in FIG. 4, which are uniformly distributed over the periphery. The sensing unit 56 is an operative connection with the sensing member 68 during an impact operation with the curved tracks 46, 48. In order to reduce the wear between the sensing means 68 and the curved tracts 46, 48, the sensing members 68 are chamfered to their side surfaces.

The 56 sensing unit is arranged axially displaceably on the striker 32 between two helical pressure springs 112, 114 (FIG. 3). The helical pressure spring 112 which faces the tool receptacle 30 is supported in direction of the tool receptacle 30 on a projection 116 formed on the striker 32 and acts in the direction opposite to the tool receptacle 30 on the sensing unit 56. The helical pressure spring 114 which faces away from the tool receptacle 30 is supported in a direction which is opposite to the tool receptacle 30 through a spring abutment 170 and through a safety ring 118 mounted on the striker 32 against the striker 32. It acts in direction of the tool receptacle 30 on the sensing unit 56.

Figure 5:
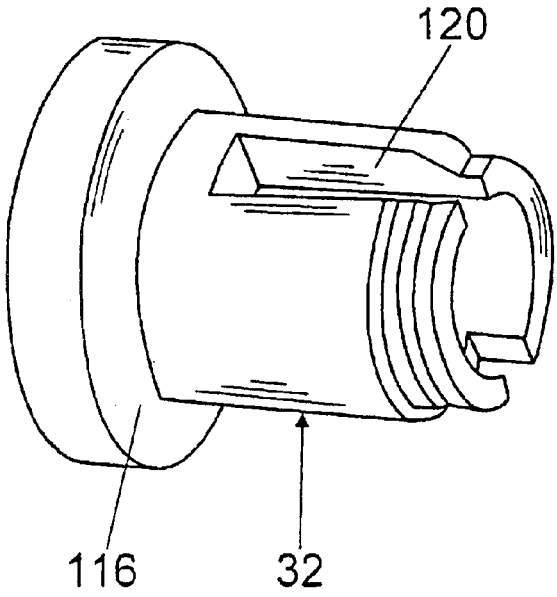
FIG. 5 is a view showing a striker of the inventive power tool inclinedly from above.

The striker 32 is formed as a hollow body and, in accordance with the present invention, is displaceably supported on the drive means 12 as shown in FIGS. 2, 3, 5. The component which forms the sensing unit 56 engages with its drive elements 110 radially inwardly through two recesses 120 of the striker 32 into two longitudinal grooves 122 of the drive means 12 as shown in FIGS. 2–5. The sensing unit 26 and the striker 32 are driveable directly rotatably from the drive means 12.

The drive means 12 together with a tool receptacle 30 is supported displaceably in the axial direction. A projection 64 of the drive means 12 forms in direction of the tool receptacle 30 an abutment for the striker 32 as shown in FIG. 3. The projection 64 is arranged in a cup-shaped sleeve which radially surrounds the striker 32. It is formed on the front curved track 44 which faces the tool receptacle 30.

When the impact drilling machine with the drill 28 is pressed against a surface to be treated, the drill 28 with the tool receptacle 30 and the drive means 12 is displaced into the housing 10, as shown in FIG. 2 in the upper half up to the middle line of the drive means 12. In the lower half in addition the striking mechanism 16 is shown in section, while in the upper part the striking mechanism 16 is shown not sectioned. The drive means 12 acts in the axial direction via a safety ring 124 and via an axial bearing 126 on the cup shaped and axially displaceable sleeve supported sleeve which forms the front curved track 44, and through the sleeve and a spring plate 128 pressed on the sleeve acts opposite to the three helical pressure springs 132 which are uniformly distributed over the periphery and arranged on the dome 130 which is fixed to the housing.

The helical pressure springs 132 are supported at the end facing away from the spring plate 128 against a spring plate 134 which is fixed with the housing. When the sleeve with the curved track 44 is displaced to its end position which faces away from the tool receptacle 30, the rotatably driven sensing unit 56 with its sensing members 68 comes to abutment with the curved paths 44,46 and drive through the helical pressure springs 112, 114 the striker 32 into its axial movement. The striking mechanism 16 is turned on. Depending on the design the drive unit 56 is released before or after a tool-side dead point from the curved track 46 which faces away from the tool receptacle 30. Another design is also possible, with which the drive unit 56 in a swinging-in condition always runs on the curved track 46. Instead of an abutment on the drive means 12, it is possible that a striker strikes directly on a tool or another suitable component which can be selected by a person skilled in the art.

When the drill 28 is removed from the surface to be treated, the helical pressure springs 132 move through the spring plate 128 the cup-shaped sleeve which forms the front curved track 44, the drive means 12 and the tool receptacle 30 with the drill 28 to an initial position. The drive means 12 with its projection 136 comes to abutment against a radial ball bearing 148 of the drive means 12 in an axial direction, which is supported in the housing 10 in the axial direction.

The curved track 44 moves in direction of the tool receptacle 30 by the spring plate 134 which forms an abutment 80, through which in an idle running position of the striking mechanism 16, the sensing unit 36 with its sensing members 68 is limited in the axial direction by the curved track 44 in its movement.

A web-shaped component 84 which is arranged in the longitudinal groove 122 moves with the drive means 12 through the curved track 46 facing away from the tool receptacle 30 and fixed by the screw pin 138 in the housing 10, and forms a second abutment 82 through which the sensing unit 56 with its sensing member 68 is limited in an axial direction to the curved track 46 in its movement as shown in FIG. 2. The web-shaped component 84 extends at the side facing away from the sensing unit 56 with a projection 140 in a radial direction from the longitudinal groove 122 and is secured axially in direction of the tool receptacle 30 via a safety ring 142 and in the direction facing away from the tool receptacle 30 via a supporting disc 144 on a toothed gear 146 of a not shown transmission of the impact drilling power tool. Through the abutments 80, 82 a contact in the idle running position of the impact mechanism 16 between the sensing member 68 and the curved tracks 46, 48 is reliably prevented.

Figure 6:
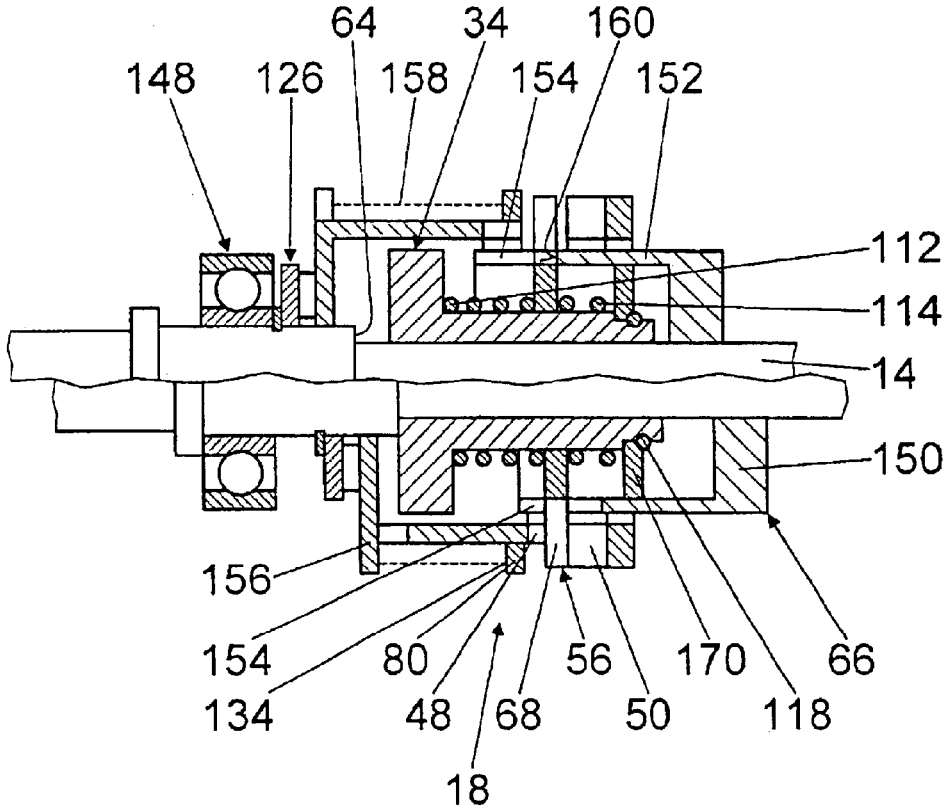
FIG. 6 is a view showing a striking unit with a separate drive part.
Figure 7:
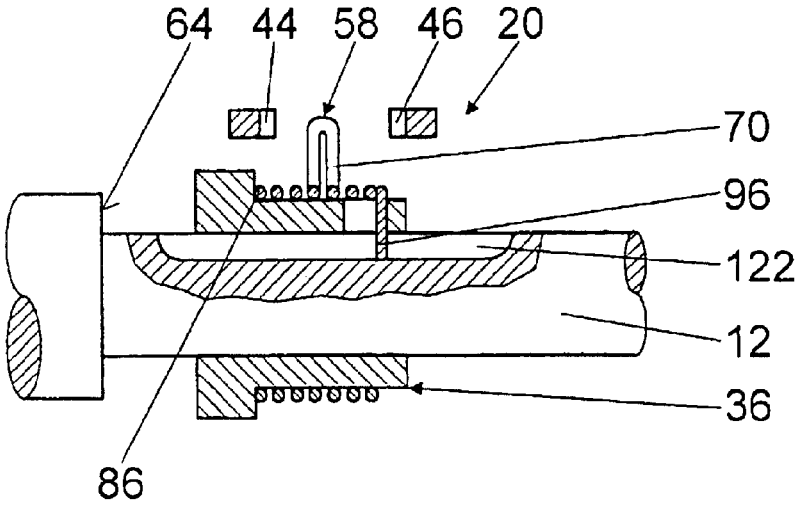
FIG. 7 is a view schematically showing a striking mechanism with a spring forming a sensing unit.
Figure 8:
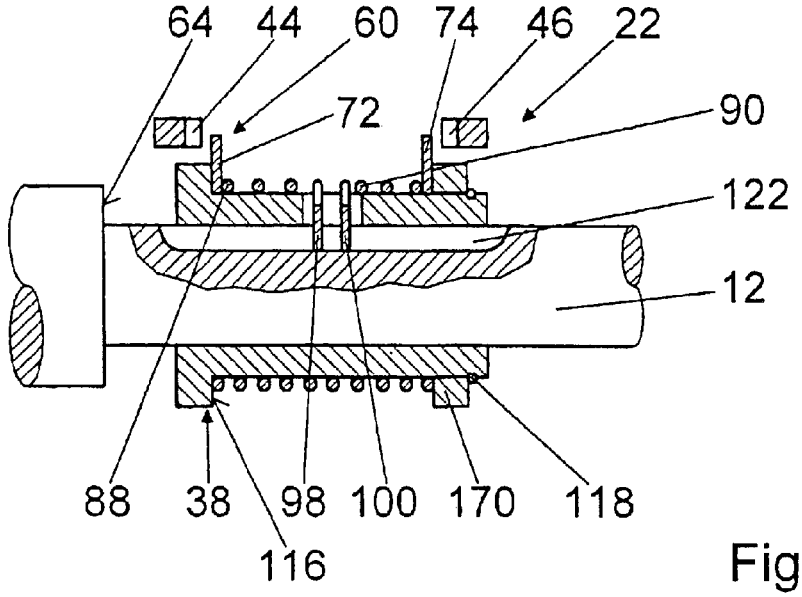
FIG. 8 is a view showing a striking mechanism which is different from that of FIG. 7 and which is provided with a sensing unit formed by two springs.

FIGS. 6–8 show a further alternative striking mechanism 18, 20, 22, 24, 26 in sections. Substantially the same components are identified with the same reference numerals. Furthermore, the same features and operation of the embodiment of FIGS. 1–5 are utilized. The subsequent description is limited substantially from the differences between the embodiment of FIGS. 1–5.

In the striking mechanism 18 shown in FIG. 6 a sensing unit 56 is connected with a cup-shaped drive part 66 which is formed separately from a drive means 14. The drive part 66 at a side which faces away from the not shown tool receptacle is non rotatably pressed with a bottom part 150 on the drive means 14 which is formed as a shaft, and extends in an axial direction toward the tool receptacle with a web 154 extending in an axial direction and formed on its cup wall 152, via a ring-shaped, housing-fixed curved track 50 in corresponding recesses of the sensing unit 56. The sensing unit 56 is driven rotatably by the drive means 14 through the drive part 66. It is displaceable in an axial direction and non rotatable on the striker 34, which is formed as a hollow body and is axially displaceable on the drive means 14. Basically it is possible to support the sensing unit rotatably on the slider.

A curved track 48 which faces the tool receptacle is formed by a cup-shaped sleeve. A spring abutment 156 for a helical pressure spring 154 which surrounds the sleeve for returning the striking mechanism 18 to its idle running position is formed on the sleeve. Contrary to the embodiment shown in FIGS. 1–5 two helical pressure springs and a separate spring plate can be eliminated. The sleeve is fixed in the housing in a rotary direction and displaceably supported in an axial direction together with the drive means 14. In the idle running position of the striking mechanism 18 the sensing unit 56 with its sensing members 68 is limited in its movement in direction of the curved track 50 by an abutment 160 formed at an end side of the cup wall 152 and in a direction of the curved track 48 by an abutment 80.

Figure 9:
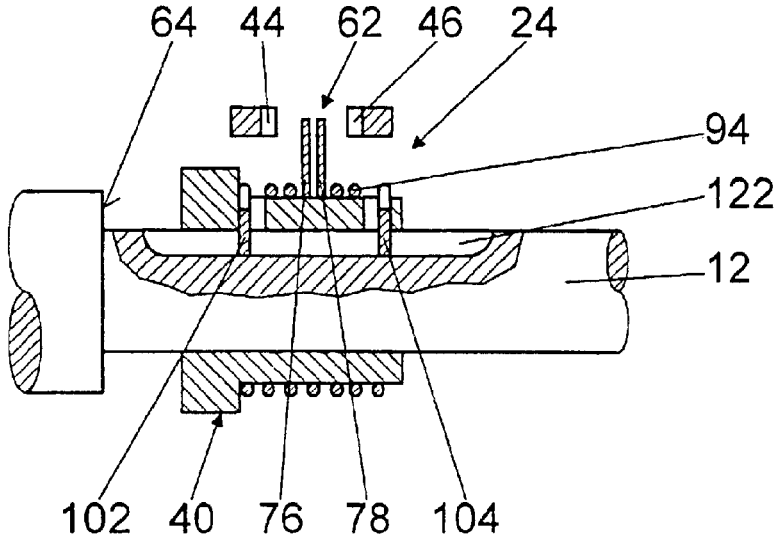
FIG. 9 is a view showing a variant of FIG. 8, with inwardly located sensing members.

In the striking mechanisms 20, 22, 24 in FIGS. 7, 8 and 9 the sensing units 58, 60, 62 are formed by springs 86, 88, 90, 92, 94 which are in operative connection with corresponding strikers 36, 38, 40. Radially outwardly facing sensing members 70, 72, 74, 76, 78 and radially inwardly facing drive elements 96, 98, 100, 102, 104 are formed of one piece on the springs 86, 88, 90, 92, 94. The drive elements 96, 98, 100, 102, 104 are engaged radially inwardly through the striker 36, 38, 40, in longitudinal grooves 122 by the drive means 12 formed as shafts.

In the embodiment of FIG. 7, the sensing unit 58 is formed as a single spring 86, and in the embodiments of FIGS. 8 and 9 it is formed by two springs 88, 90, 92, 94 which are supported relative to one another. In FIG. 8 the drive elements 98, 100 are arranged in an axial direction inwardly and the sensing member 72, 74 outwardly, and in FIG. 9 the drive elements 102, 104 are arranged in an axial direction outwardly and the sensing members 76, 78 are arranged inwardly.

Figure 10:
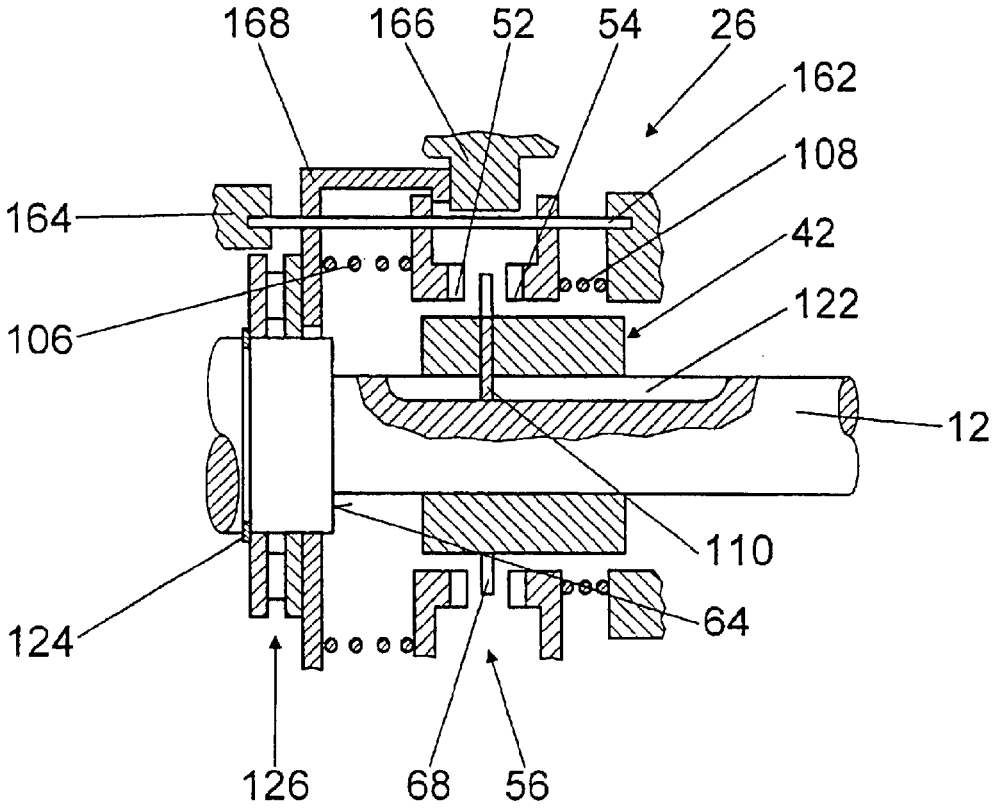
FIG. 10 is a view schematically showing the striking mechanism with curved tracks which are supported displaceably against the springs.

The striking mechanism 26 in FIG. 10 has two curved tracks 50, 54, which are formed by ring-shaped components and are arranged axially displaceably against helical pressure springs 106, 108. The helical pressure springs 106, 108 are tensioned by a sensing unit 56 and are arranged at a side of the curved tracks 52, 54, which face away from the sensing unit 56. The helical pressure spring 106 which faces a tool receptacle is supported at the end facing away from the sensing unit 56 through a cup-shaped sleeve 168 which surrounds the curved tracks 52, through an axial bearing 126, and through a safety ring 124 against the drive means 12 formed as a shaft. It acts in a direction which is opposite to the work receptacle on the curved track 52. The helical pressure spring 108 which faces away from the tool receptacle is supported at its end facing away from the sensing unit 56 against a housing 164 and acts in direction of the tool receptacle on the curved track 54.

The curved tracks 52, 54 are guided axially through the webs 162 and non rotatably fixed in the housing 164. In direction toward the sensing unit 56, the curved tracks 52, 54 are limited by a projection 166 formed on the housing 164. The curved track 52 which faces the tool receptacle is supported in direction of the sensing unit 56 against the projection 156 through a radially inwardly extending collar of the sleeve 168. The sensing unit 56 is designed in correspondence with the sensing unit 56 in FIGS. 1–5. It is connected with the striker 42 and the drive means 12, through elements 110 which engage radially inwardly through a recess of a striker 42, in longitudinal grooves 122 in the drive means 12.

It will be understood that each of the elements described above, or two or more together, may also find a useful application in other types of constructions differing from the types described above.

While the invention has been illustrated and described as embodied in hand power tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A hand-held power tool formed as an impact drilling power tool, comprising a housing; drive means which is drivingly supported in said housing for rotatably driving a tool; a mechanical striking mechanism for a striking operation of a tool in a tool receptacle and having a striker; a drive unit through which said striker is drivable in its striking movement, said drive unit having at least one curved track with raised portions and depressed portions extending in an axial direction of the tool; a sensing unit which is in operative connection with said striker and has at least one sensing member which is bringable in operative connection with said raised portions and depressed portions of said curved track, said striker being supported on said drive means, said striker being mounted on an outside of said drive means.

2. A hand held power tool as defined in claim 1, wherein said drive means is supported axially displaceably and has a projection which in direction to said tool receptacle forms an abutment for said striker.

3. A hand held power tool as defined in claim 1, wherein said sensing unit has at least two sensing members which are bringable in operative connection with two such curved tracks.

4. A hand held power tool as defined in claim 1, wherein said at least one said sensing member of said sensing unit is limited in its movement in an idle running position in an axial direction at least to one curved track by an abutment.

5. A hand held power tool as defined in claim 4, wherein said drive means is supported axially displaceable, said abutment being formed by further means which is fixedly arranged on said drive means.

6. A hand held power tool as defined in claim 1; and further comprising at least one spring which is in operative connection with said striker and forms at least one drive element of said sensing unit.

7. A hand held power tool as defined in claim 1, wherein said curved path is displaceably supported against a tensioned spring through said sensing unit.

8. A hand held power tool as defined in claim 1, wherein said drive unit has only one curved track.

9. A hand-held power tool formed as an impact drilling power tool, comprising a housing; drive means which is drivingly supported in said housing for rotatable driving a tool; a mechanical striking mechanism for a striking operation of a tool in a tool receptacle and having a striker; a drive unit through which said striker is drivable in its striking movement, said drive unit having at least one curved track with raised portions and depressed portions extending in an axial direction of the tool; a sensing unit which is in operative connection with said striker and has at least one sensing member which is bringable in operative connection with said raised portions and depressed portions of said curved track, said striker being supported on said drive means, said striker being mounted on an outside of said drive means, said drive means being supported axially displaceably and having a projection which in direction to a receptacle forms an abutment for said striker; and a cup-shaped sleeve, said curved track being arranged on said cup-shaped sleeve, said projection being arranged inside said sleeve.

10. A hand-held power tool formed as an impact drilling power tool, comprising a housing; drive means which is drivingly supported in said housing for rotatably driving a tool; a mechanical striking mechanism for a striking operation of a tool in a tool receptacle and having a striker; a drive unit through which said striker is drivable in its striking movement, said drive unit having at least one curved track with raised portions and depressed portions extending in an axial direction of the tool; a sensing unit which is inoperative connection with said striker and has at least one sensing member which is bringable in operative connection with said raised portions and depressed portions of said curved track, said striker being supported on said drive means, said striker being mounted on an outside of said drive means, said drive means being a shaft, at least a part of said sensing unit being non rotatably connected with said drive means and drivable directly from said drive means.

11. A hand-held power tool formed as an impact drilling power tool, comprising a housing; drive means which is drivingly supported in said housing for rotatably driving a tool; a mechanical striking mechanism for a striking operation of a tool in a tool receptacle and having a striker which is hollow and surrounds said drive means; a drive unit through which said striker is drivable in its striking movement, said drive unit having at least one curved track with raised portions and depressed portions extending in an axial direction of the tool; a sensing unit which is in operative connection with said striker and has at least one sensing member which is bringable in operative connection with said raised portions end depressed portions of said curved track, said striker being supported on said drive means, said striker being mounted on an outside of said drive means.

* * * * *